US009053852B2

(12) United States Patent
Langer et al.

(10) Patent No.: US 9,053,852 B2
(45) Date of Patent: Jun. 9, 2015

(54) ERROR COMPENSATION FOR CURRENT TRANSFORMER SENSORS

(75) Inventors: George O. Langer, Boulder, CO (US); Christopher Scott Brown, Longmont, CO (US); Samad Seyfi, Longmont, CO (US)

(73) Assignee: Magnelab, Inc., Longmont, CO (US)

( * ) Notice: Subject to any disclaimer, the term of this patent is extended or adjusted under 35 U.S.C. 154(b) by 0 days.

(21) Appl. No.: 13/453,949

(22) Filed: Apr. 23, 2012

(65) Prior Publication Data

US 2012/0268100 A1 Oct. 25, 2012

Related U.S. Application Data

(60) Provisional application No. 61/478,018, filed on Apr. 21, 2011.

(51) Int. Cl.

| | |
|---|---|
| ***H01F 38/28*** | (2006.01) |
| ***H01F 38/32*** | (2006.01) |
| ***H01F 27/42*** | (2006.01) |

(52) U.S. Cl.

CPC ..... *H01F 38/32* (2013.01); *H01F 27/427* (2013.01)

(58) Field of Classification Search

CPC ..... H01F 27/427
USPC ..... 323/357, 342, 344, 358, 218; 363/21.17, 56.03, 56.07, 56.1
See application file for complete search history.

(56) References Cited

U.S. PATENT DOCUMENTS

| | | | | |
|---|---|---|---|---|
| 3,701,008 | A | 10/1972 | Kusters et al. | |
| 3,705,990 | A * | 12/1972 | Pileckis | 327/449 |
| 4,198,595 | A | 4/1980 | Milkovic | |
| 4,652,810 | A | 3/1987 | Hayashi | |
| 4,672,324 | A * | 6/1987 | van Kampen | 307/653 |
| 6,177,791 | B1 | 1/2001 | Lenhard | |
| 6,590,380 | B2 | 7/2003 | Edel | |
| 2007/0007942 | A1 | 1/2007 | King et al. | |
| 2007/0007945 | A1 | 1/2007 | King et al. | |
| 2007/0086223 | A1 * | 4/2007 | Uchida | 363/52 |
| 2010/0213926 | A1 * | 8/2010 | Wallis | 324/124 |

* cited by examiner

*Primary Examiner* — Matthew Nguyen
*Assistant Examiner* — Trinh Dang
(74) *Attorney, Agent, or Firm* — James R. Young; Cochran Freund & Young LLC

(57) ABSTRACT

Phase angle error and ratio error correction is provided in a current transformer by a bucking voltage opposite in phase to the voltage drop across the burden resistor and inherent winding resistance.

13 Claims, 2 Drawing Sheets

EQUIVALENT CIRCUIT
OF SECONDARY WINDING $$\frac{I_0}{I_{IN}/N_2} = \frac{1}{1 + \frac{R_W + R_B}{j\omega L}}$$

$V_{BUCKING} \cong -(IR_W + IR_B)$ $$\frac{I_0}{I_{IN}/N_2} = \frac{1}{1 + \frac{R_W + R_B}{j\omega L}}$$

EFFECTIVE $R_W = R_W - R_B G$

ERROR COMPENSATION FOR CURRENT TRANSFORMER SENSORS

BACKGROUND

1. Technical Field of the Invention

This invention is related to current transformers, including error compensation for improving output accuracy of current transformers.

2. State of the Prior Art

Current transformers are electrical devices that can provide a small, measurable current or voltage output signal that is indicative of a larger current flowing in an electric line, so they are often used as a component in electrical metering, monitoring, recording, and control instruments where large, high power, transmission or load situations would make direct measurements of electric current impractical or unsafe. Current transformers also isolate the measuring instruments from high voltages in such high power conductors or circuits.

Of course, accuracy and reliability are always at least of some concern in measuring devices, depending the applications and uses of the measurements. For current transformers, especially those used in revenue metering instruments where customers or users may be charged based on the amount of electric power used, the accuracy of the current transformer output signals for measuring current flowing in the electric line, thus electric power delivered by the electric line or used by a load connected to the electric line, is very important. Customers do not want to be charged for electric power that they do not use, and electric utility providers want to be sure that they are charging for all the power that a customer uses.

However, current transformers have inherent physical characteristics that result in current measurement errors, including ratio errors and phase angle errors, both of which affect the accuracy of current measurements made with current transformers. Ideally, the output signal of a current transformer is a specific ratio to the input current of a primary winding, for example, a primary winding in the form of a high power electric line, where the ratio is equal to the ratio number of turns of the wire that forms the primary winding to the number of turns of the wire that forms the secondary winding of the current transformer. However, a number of physical characteristics of the current transformer, such as the magnetic core materials, core construction, electrical resistances and reactances, and other parameters result in the output signals being somewhat less than the ideal ratio relationship to the input current being measured. Such ratio error results in the output signals of current transformers being somewhat less than accurate indicators or measurements of the input current. Ideal output signals would also be exactly in phase with the input current. However, some of the same physical characteristics that cause ratio errors in current transformers also cause the output signals to be somewhat out of phase with the input current being measured. Such phase angle errors do not cause significant accuracy problems for measurement of current, but, if the output measurements are used for measuring electric power, such phase angle errors can be very significant and can cause significant accuracy issues for electric power measurements and metering. Since public utilities charge customers for electric power used, measuring and metering electric power with current transformers that have even small phase angle errors may not have sufficient accuracy to meet such electric power and metering needs.

Persons skilled in the art know that increasing inductance and reducing resistance of current transformers can improve accuracy and that more turns of the wire in the secondary winding will provide more inductance. However, increasing the number of turns also requires more wire, thus also increases resistance, and more turns with more wire causes the physical size to be larger. If keeping the physical size small is a design criterion, more turns could be accommodated with thinner wire to keep physical size small, but thinner wire would also result in more resistance. Therefore, it is difficult to provide more inductance and at the same time reduce resistance.

The foregoing examples of the related art and limitations related therewith are intended to be illustrative and not exclusive. Other limitations of the related art will become apparent to persons skilled in the art upon a reading of this material.

BRIEF DESCRIPTION OF THE DRAWINGS

The accompanying drawings, which are incorporated herein and form a part of the specification, illustrate some, but not the only or exclusive, example embodiments and/or features. It is intended that the embodiments and figures disclosed herein are to be considered illustrative rather than limiting.

In the drawings.

DETAILED DESCRIPTION OF EXAMPLE EMBODIMENTS

Figure 1:
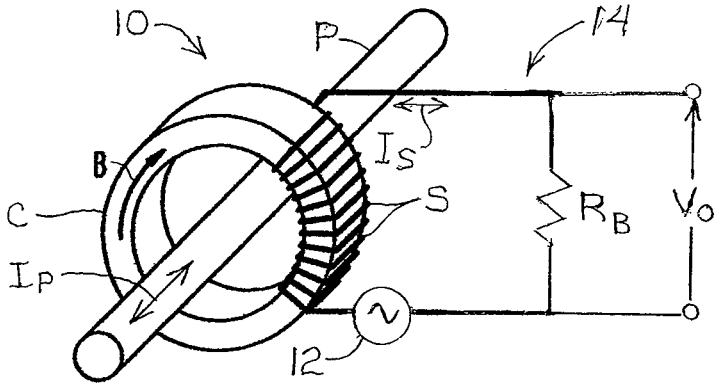
FIG. 1 is a diagrammatic view of an example current transformer equipped with a bucking voltage component for minimizing error current for accurate output signals indicative of primary current flow.

An example current transformer 10 equipped with an example output correcting, bucking voltage generator circuit 12 in the secondary output circuit 14 is illustrated diagrammatically in FIG. 1. The example bucking voltage generator circuit reduces both ratio error and phase angle error by actively and effectively reducing or cancelling overall resistance in the current transformer secondary (e.g., output) circuit and reducing or eliminating voltage across the secondary winding inductance, thus reducing or eliminating induction current loss, as will be explained in more detail below. Like other typical current transformers, the example current transformer 10 depicted in FIG. 1 includes a magnetic core C in which an alternating current $I_P$ in a primary winding P produces a magnetic field B and a secondary winding S in which the magnetic field B induces a secondary alternating current $I_S$. In a typical current transformer application used for measuring current $I_P$ in a primary conductor P, such as a high power wire, bus bar, or other conductor, the secondary winding S comprises a length of insulated wire wrapped many times (e.g., tens or hundreds of turns) around at least a portion of the magnetic core C. The primary winding P could be a permanent part of the current transformer 10, or, the current transformer 10 could be a window-type current transformer in which a conductor P can be placed through the open middle of the core C as illustrated in FIG. 1. When a conductor P that carries the primary current $I_P$ is placed through the middle opening of the core C as illustrated in FIG. 1, the conductor P effectively functions as a single-turn primary winding of the current transformer 10.

In an ideal current transformer, the secondary current $I_S$ is exactly equal to the primary current $I_P$ multiplied by the ratio of the turns $N_1$ in the primary winding P to the number of turns $N_2$ in the secondary winding S, i.e., $I_S=I_P(N_1/N_2)$. Therefore, in current transformers wherein the primary winding is one conductor P extending through the opening in the middle of the core C as shown in FIG. 1 and explained above, the one conductor P constitutes a primary winding with essentially one turn, so $N_1=1$. Consequently, the ideal secondary current $I_S$ for a current transformer 10 with a single primary conductor P passing through the middle of the core C as a single turn would be exactly equal to the primary current $I_P$ divided by the number of secondary turns $N_2$, i.e., $I_S=I_P(1/N_2)$. However, such ideal mathematical relationships are not attainable or even possible in a real physical system.

Figure 2:
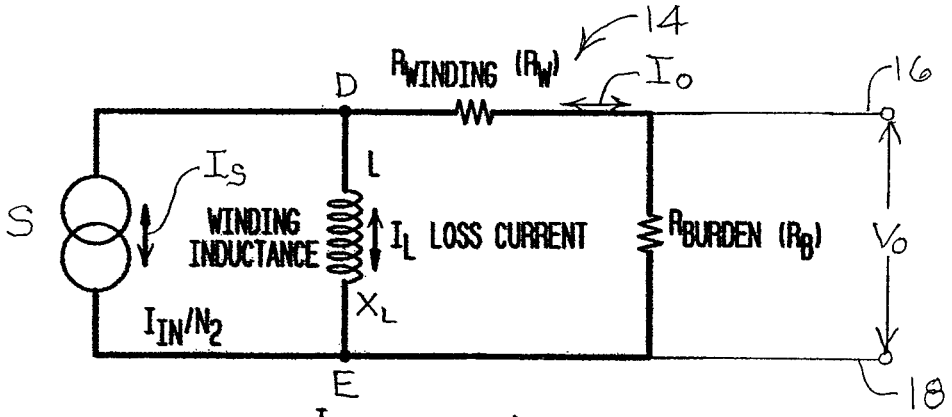
FIG. 2 is a schematic circuit diagram illustrating an equivalent circuit of a secondary winding of a typical, conventional current transformer used for measuring or metering current by measuring or metering an output voltage drop across a burden resistor illustrating the inherent winding resistance and winding inductance as equivalent discrete components for convenience.

In a real current transformer, as illustrated by the equivalent circuit diagram in FIG. 2, the real secondary output current $I_O$ in the secondary output circuit 14 is slightly smaller than the ideal secondary current $I_S$, because a small part of the secondary current $I_S$, referred to herein as inductive loss current $I_L$, is diverted to flow through the magnetizing inductance L in parallel with the burden resistance $R_B$. The secondary winding S of a real current transformer 10 also has inherent resistance in the wire that forms the secondary winding S, which is depicted in the equivalent output circuit 14 as an equivalent winding resistance $R_W$ in series with the burden resistance $R_B$ in FIG. 2. As noted above, the inductance L and the secondary winding resistance $R_W$ are inherent physical characteristics of a current transformer secondary circuit, not distinct components, but they are shown as equivalent distinct components L and $R_W$, respectively, in the equivalent circuit of FIG. 2 and in the equivalent circuit of FIG. 4 to facilitate describing and analyzing the current transformer secondary circuit without the output correcting, bucking voltage generator circuit 12 (e.g., FIG. 2) and with the output correcting, bucking voltage generator circuit 12 (e.g., FIG. 4). Persons skilled in the art are familiar with, and understand, the technique of using equivalent circuits for description and analysis.

The burden resistance $R_B$ is typically provided in current transformer output circuits to create a output voltage drop $V_O$ across the burden resistance $R_B$, which is indicative of the output current $I_O$ and can be measured with a voltage meter or other measuring instrumentality, for example, at output measurement leads 16, 18 (FIG. 2). Consequently, the burden resistance $R_B$ is sometimes called the sense resistance. As explained above, the ideal secondary current $I_S$ is directly related to the input current, i.e., the principal current $I_P$ in the primary conductor C, so, in the absence of the inductive loss current $I_L$ and the equivalent winding resistance $R_W$, the output voltage $V_O$ signal across the output leads 16, 18 would be directly proportional to the primary current $I_P$ in the primary conductor C. The winding resistance $R_W$ and the burden resistance $R_B$ do not vary the phase relationship between the voltage and the current. Therefore, the resistances $R_W$ and $R_B$ introduce only a ratio error between the input current $I_P$ in the primary conductor C and the output voltage $V_O$, which is linear and fairly easy to correct.

However, the winding inductance L is reactive, so the inductive loss current $I_L$ is almost ninety degrees out of phase with the input current $I_P$ in the primary conductor C, which affects the output circuit 14 and introduces a phase angle error in the output voltage $V_O$, i.e., causes the output voltage $V_O$ to be slightly out of phase with the input current $I_P$ in the primary conductor C. The phase angle error is non-linear and more difficult to correct, and it can cause significant inaccuracies when the current transformer is used to measure or meter electric power, especially at lower frequencies, such as the 50 to 60 Hz frequencies that are common for conventional utility power in many countries.

We have found that the inductive loss current $I_L$ is equal to the ratio of the voltage drop in the total secondary circuit resistance (e.g., $R_W$ plus $R_B$) to the inductive reactance $X_L$ of the winding S. According to Ohm's law (V=IR), the voltage drop in the total secondary resistance ($R_W+R_B$ in FIG. 2) is $I_OR_W+I_OR_B$, i.e., $I_O(R_W+R_B)$. Therefore, this relationship can be expressed as:

$$I_L = \frac{I_O(R_W + R_B)}{X_L} \quad \text{(Equation 1)}$$

Since the inductive reactance $X_L=\omega L$, where ωis the angular frequency, and impedance $Z=R+jX_L$, but there is no resistive component in the pure inductor L in the equivalent circuit, the relationship in Equation 1 can also be expressed in terms of inductive impedance jωL of the winding S, i.e., $$I_L = \frac{I_O(R_W + R_B)}{j\omega L} \quad \text{(Equation 2)}$$

Consequently, according to that relationship, if the total secondary circuit resistance, e.g., $(R_W+R_B)$, could be reduced to approach or even equal zero, the inductive loss current $I_L$ could be reduced or even eliminated. As explained above, because the inductive loss current $I_L$ is due to the transformer inductance, which is reactive, the inductive loss current $I_L$ causes a phase angle error in the output $V_O$. Therefore, a reduction or elimination of the inductive loss current $I_L$ by reducing or eliminating the total secondary circuit resistance will reduce or eliminate the phase angle error in the output $V_O$.

Further, reducing or eliminating the total secondary circuit resistance can also reduce or eliminate the ratio error in the current transformer. As explained above, in an ideal current transformer, the output current $I_O$ of the secondary circuit 14 would be equal to the input current $I_P/N_2$, where the primary conductor P is essentially one winding, thus $N_1=1$, so the ratio of the output current $I_O$ to $I_P/N_2$ would be equal to 1. However, in a real current transformer, as shown by the equivalent circuit of FIG. 2, the total secondary current $I_S=I_P/N_2$, but the output current $I_O$ is not the same as the ideal secondary current $I_S$. Instead, $I_S=I_O+I_L$. Therefore, using the relationship in Equation 2, the ratio of output current $I_O$ to $I_P/N_2$ is actually:

$$\frac{I_O}{I_P/N_2} = \frac{1}{1 + \frac{R_W + R_B}{j\omega L}} \quad \text{(Equation 3)}$$

Figure 3:
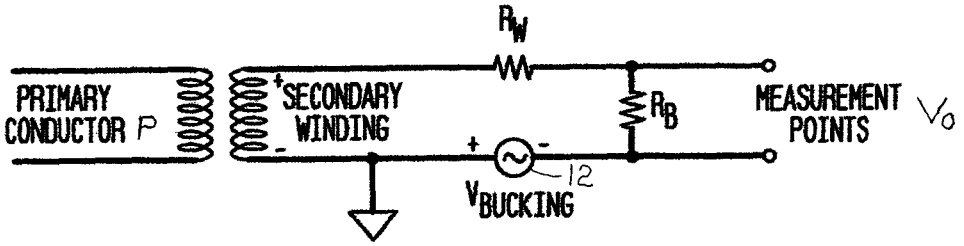
FIG. 3 is a schematic diagram of an example current transformer secondary winding circuit equipped with an example output correcting, bucking voltage generator circuit.

From Equation 3, it can be seen that if the induction L is very large, then the ratio of the output current $I_O$ to $I_P/N_2$ would approach 1. It can also be seen that if the total secondary circuit resistance, e.g., $R_W+R_B$, could be reduced or brought to zero, then the ratio of the output current $I_O$ to $I_P/N_2$ would be reduced or made closer to or equal to 1. We supply a bucking voltage $V_{BUCKING}$—in the current transformer secondary circuit 14 with opposite phase to the voltage drop across $R_W+R_B$ as illustrated in FIGS. 1 and 3 to effectively reduce or eliminate the voltage drop across $R_W+R_B$ and thereby reduce or eliminate both phase angle error and ratio error of a given current transformer with given physical characteristics, e.g., core size and configuration, core material, size and turns of winding wire, and other typical current transformer physical characteristics.

Figure 4:
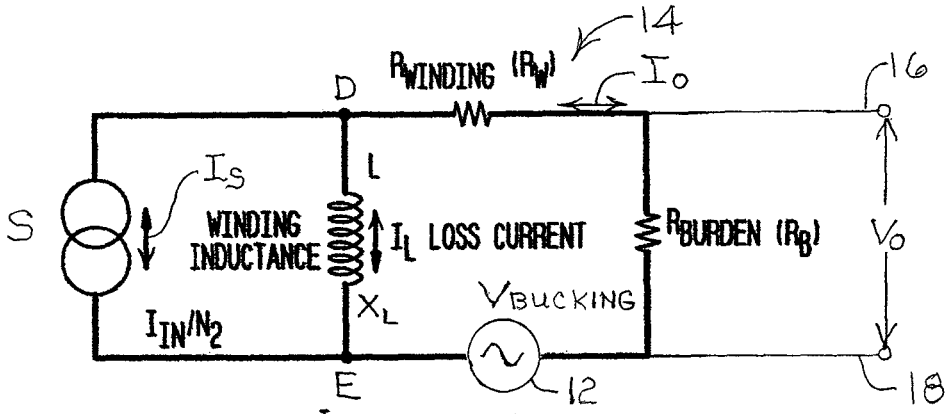
FIG. 4 is a schematic diagram of an example equivalent circuit similar to the equivalent current transformer secondary winding circuit in FIG. 2, but also including an output correcting, bucking voltage generator circuit.

Without the bucking voltage generator 12 of this invention, the voltage DE across the winding inductance L in the equivalent circuit of FIG. 2 would be proportional to the product of the secondary current Is and the output circuit resistances (winding resistance $R_W$ plus burden resistance $R_B$). Therefore, to increase the current measuring accuracy of the current transformer 10, a bucking voltage $V_{BUCKING}$ opposite in phase to the equivalent voltage DE is applied between the transformer winding S and the burden resistor $R_B$, i.e., in electrical series with both the winding resistance Rw and the burden resistance $R_B$, as indicated by the bucking voltage generator 12 in FIGS. 1, 3, and 4. The location of the bucking voltage generator 12 in the secondary circuit 14 is not limited to the location shown in FIGS. 1 and 3, but can be in any position in the secondary circuit. For example, the bucking voltage generator could be on either side of the burden resistance $R_B$. FIG. 3 is a schematic circuit diagram of the example current transformer 10 in FIG. 1 equipped with a bucking voltage generator 12, and FIG. 4 is the equivalent circuit diagram as explained above. The bucking voltage $V_{BUCKING}$ provided, for example, by the bucking voltage generator 12 effectively reduces or eliminates the voltage DE across the winding inductance L, i.e., eliminates the voltage drop across both the winding resistance $R_W$ and the burden resistance $R_B$, as best seen in FIG. 4, which reduces or eliminates the inductive loss current $I_L$. Such reduction or elimination of the inductive loss current $I_L$ reduces the phase angle error and ratio error between the input current $I_P$ in the primary conductor P and the output voltage $V_O$, as explained above, thus increases the accuracy of the current measuring capability of the current transformer 10.

Figure 5:
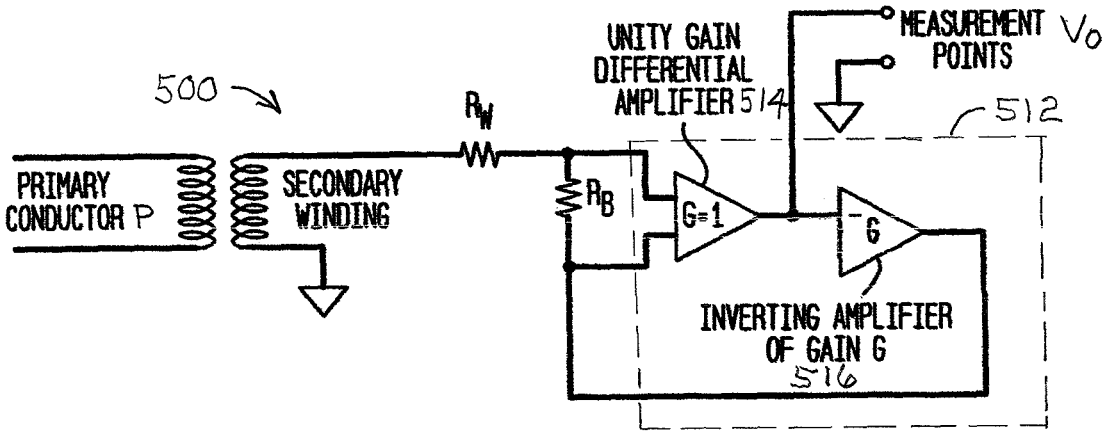
FIG. 5 is a schematic diagram of an example current transformer secondary winding circuit equipped with another example output correcting, bucking voltage generator circuit.

An example current transformer circuit 500 is shown in FIG. 5 with an example bucking voltage generator circuit 512 for effectively reducing the voltage across the winding inductance to reduce inductive error current and consequent phase angle error for more accurate current measuring capability, as explained above. The example bucking voltage generator circuit 512 includes a unity gain differential amplifier 514, the input terminals of which are driven by the voltage across the burden resistor $R_B$. The output of the unity gain differential amplifier 514 drives the inverting input of an inverting amplifier 516 of gain G, and the output of the inverting amplifier 516 is connected to the burden resistor $R_B$ and the inverting input of the differential amplifier 514. The effect of this feedback connection from the inverting amplifier 516 to the inverting input of the differential amplifier 514 is to make the effective value of the input resistance, i.e., the ratio of voltage to current at the non-inverting input of the differential amplifier 514, to be negative for any gain greater than one. Therefore, when a current transformer is connected in series to the burden resistor $R_B$ and to the amplifiers 514, 516 as shown in FIG. 5 and described above, this negative signal is subtracted from the positive resistance of the transformer. The result is a smaller current $I_L$ flow in the transformer magnetizing inductance L (see FIG. 2), which significantly reduces the phase angle error as explained above. The gain G of the inverting amplifier 516 should be a value that leads to reduction or cancellation of the contribution of the voltage drops in the secondary circuit 14 due to the burden resistance $R_B$ and the winding resistance $R_W$ to the output current $I_O$. However, the gain G should not be greater than $(R_w/R_B)+1$, which would result in the output voltage of the amplifier 516 being greater than the voltage drops in the secondary circuit 14 due to the burden resistance $R_B$ and the winding resistance $R_w$ to the output current $I_O$, i.e., greater than $I_O(R_w+R_B)$, which would cause the circuit to become unstable. In other words, if the offset (bucking) voltage is greater than the actual voltage drop across $R_W+R_B$ combined, the circuit will be unstable. Therefore, the gain G of the amplifier 516 should be a value in a range that is greater than 1 but not greater than $(R_W/R_B)+1$, i.e., $1 < G \leq [(R_W/R_B)+1]$. Some circuit designers may want to provide a gain G as close to $(R_W/R_B)+1$ as practical without going greater than $(R_w/R_B)+1$ in order to eliminate as much of the phase angle error as practical without the circuit becoming unstable.

In summary, the example bucking voltage generator circuit 512 described above measures the output voltage $V_O$ signal of a current transformer secondary circuit and injects a signal voltage back to the transformer to actively and effectively reduce or cancel the total resistance of the secondary circuit of a current transformer. Such reduction or cancellation of the winding and burden resistances (e.g., $R_W$ and $R_B$ in FIGS. 2 and 4) effectively reduces the voltage DE across the winding induction L, which reduces the inductive loss current $I_L$ (FIGS. 2 and 4). Therefore, both ratio error and phase angle error of the current transformer are reduced significantly or eliminated by the bucking voltage generator 12 described above, which can be implemented by the example bucking voltage generator circuit 512 shown in FIG. 5 or by any other circuit that actively reduces the effective resistances in a secondary (output) circuit of a current transformer. The unity gain amplifier 514 measures the voltage across the burden resistor RB for an output voltage $V_O$ that is indicative of the input current $I_P$, but the bucking voltage circuit 512 effectively makes both $R_B$ and $R_W$ partially or completely "invisible" to the secondary winding S of the current transformer, depending on the value provided for the gain G as explained above so that the output voltage $V_O$ is a more accurate indication of the input current $I_P$ in the primary conductor P. The bucking voltage generator circuit 512 in FIG. 5 provides a bucking voltage contribution of —G times the voltage drop across $R_B$. The negative sign is important to note as it leads to a reduction or cancellation of the contribution of the voltage drops in the secondary circuit due to $R_B$ and $R_W$ from $I_O$ as explained above.

The bucking voltage generator 12 can be part of the current transformer secondary (output) circuit, or it could be implemented as a separate circuit connected to a current transformer secondary circuit. Therefore, use of the bucking voltage generator 12 as described above enables a current transformer that has a given magnetic structure and winding to provide more accurate current measurements than the same current transformer without such a bucking voltage generator.

Also, myriad other amplifier arrangements and combinations can be provided to produce and apply a bucking voltage as described above, as will become apparent to persons skilled in the art once they understand the principals of this invention. For example, if the output of the amplifier 514 was provided to the amplifier 516 in a manner that was a fraction or a multiple of the voltage drop across $R_B$, the amplifier 516 could have a gain that takes that fraction or multiple into account and compensate accordingly when producing a bucking voltage for application to the secondary circuit to reduce or cancel the total resistance in the secondary circuit as explained above. As another example, the unity gain amplifier 514 could invert the signal, so the amplifier 516 does not have to invert it. Of course a $V_O$ measuring circuit (not shown) could take such variations into account.

While a number of example aspects, implementations, and embodiments have been discussed above, persons skilled in the art will recognize certain modifications, permutations, additions, variations, and subcombinations thereof, in addition to those examples mentioned above. It is therefore intended that the following appended claims hereafter introduced are interpreted to include all such modifications, permutations, additions, and subcombinations as are within their true spirit and scope. The words "comprise," "comprises," "comprising," "comprised," "compose," "composing," "composed," "have," "having," "include," "including," and "includes" when used in this specification and in the following claims are intended to specify the presence of stated features, components, steps, or parts thereof, but they do not preclude the presence or addition of one or more other components, features, steps, or parts thereof.

The invention claimed is:

1. A current transformer apparatus comprising:

a magnetic core;

a secondary circuit comprising a secondary winding on the magnetic core;

a burden resistance connected to the secondary circuit across the secondary winding: and a bucking voltage generator circuit connected to the secondary circuit in electrical series with both the secondary winding and the burden resistance, wherein the bucking voltage generator circuit includes an amplifier circuit that amplifies and inverts a voltage drop across the burden resistance with a gain G in a range of $1<G\leq[(R_W/R_B)+1]$, where $R_W$ is a resistance of the secondary winding and $R_B$ is the burden resistance, to provide a bucking voltage in the secondary circuit that actively and effectively reduces or cancels a total resistance in the secondary circuit resulting from the resistance of the secondary winding and the burden resistance.

2. The current transformer apparatus of claim 1, wherein the bucking voltage provided by the generator circuit is opposite in phase to a voltage drop across the secondary winding and the burden resistance.

3. A method of increasing measuring accuracy of a current transformer that has a magnetic core in which an input alternating current to be measured produces a magnetic field and in which the magnetic field induces a secondary alternating current in a secondary winding on the magnetic core to flow in a secondary circuit through a burden resistance in the secondary circuit to produce a voltage drop that is indicative of the input alternating current, comprising applying a bucking voltage in the secondary circuit in series with both the secondary winding and the burden resistance that actively and effectively reduces or cancels a total resistance in the secondary circuit resulting from an inherent secondary winding resistance and the burden resistance by inverting and amplifying a voltage drop across the burden resistance by a gain in a range of $1<G\leq[(R_W/R_B)+1]$, where $R_W$ is the secondary winding resistance and $R_B$ is the burden resistance.

4. The method of claim 3, wherein the bucking voltage is opposite in phase to the voltage drop across the total resistance in the secondary circuit from the secondary current in the secondary circuit.

5. The method of claim 4, including generating the bucking voltage by amplifying and inverting the voltage drop across the burden resistor.

6. Error compensation apparatus for a current transformer sensor that has a secondary winding on a transformer magnetic core and a burden resistance across the secondary winding, comprising:

a bucking voltage generator circuit which multiplies a voltage drop across the burden resistance with a gain G in a range of $1<G\leq[(R_W/R_B)+1]$, where $R_W$ is an inherent resistance in the secondary winding and $R_B$ is the burden resistance, and which inverts the multiplied voltage drop to produce a bucking voltage for connection in electrical series with both the secondary winding and the burden resistance to actively and effectively reduce or cancel a total resistance resulting from the inherent resistance in the secondary winding and the burden resistance.

7. The error compensation apparatus of claim 6, wherein the bucking voltage generator circuit provides the bucking voltage that is opposite in phase to a voltage drop across the inherent winding resistance and the burden resistance from current generated in the secondary winding.

8. The error compensation apparatus of claim 6, wherein the bucking voltage generator circuit provides the bucking voltage that is opposite in phase to a voltage drop across the inherent winding resistance and the burden resistance from current generated in the secondary winding.

9. The error compensation apparatus of claim 7, wherein the bucking voltage generator circuit includes an amplifier that multiplies and inverts the voltage drop across the burden resistance to produce the bucking voltage.

10. The error compensation apparatus of claim 7, wherein the bucking voltage generator circuit includes an amplifier that multiplies and inverts the voltage drop across the burden resistance to produce the bucking voltage.

11. The error compensation apparatus of claim 9, wherein the amplifier has a gain G in a range of $1<G\leq[(R_W/R_B)+1]$.

12. The error compensation apparatus of claim 11, wherein the amplifier has a gain G in a range of $1<G\leq[(R_W/R_B)+1]$.

13. Error compensation apparatus for a current transformer sensor that has a secondary winding on a transformer magnetic core, comprising:

a burden resistance for connection across the secondary winding; and a bucking voltage generator circuit which multiplies a voltage drop across the burden resistance with a gain G in a range of $1<G\leq[(R_W/R_B)+1]$, where $R_W$ is an inherent resistance in the secondary winding and $R_B$ is the burden resistance, and which inverts the multiplied voltage drop to produce a bucking voltage for connection in electrical series with both the secondary winding and the burden resistance to actively and effectively reduce or cancel a total resistance resulting from the inherent resistance in the secondary winding and the burden resistance.

* * * * *